US007237312B2

(12) United States Patent
Enns

(10) Patent No.: US 7,237,312 B2
(45) Date of Patent: Jul. 3, 2007

(54) UTILITY POLE ASSEMBLY METHOD AND APPARATUS

(76) Inventor: Jerry Gordon Enns, 10011 E. Locust Rd., Holmesville, NE (US) 68130

( * ) Notice: Subject to any disclaimer, the term of this patent is extended or adjusted under 35 U.S.C. 154(b) by 0 days.

(21) Appl. No.: 11/108,510

(22) Filed: Apr. 18, 2005

(65) Prior Publication Data

US 2005/0211963 A1 Sep. 29, 2005

Related U.S. Application Data

(63) Continuation of application No. 10/002,770, filed on Nov. 15, 2001, now abandoned.

(51) Int. Cl.
*B23Q 3/00* (2006.01)
*E04B 1/00* (2006.01)

(52) U.S. Cl. ..... 29/468; 29/464; 29/466; 29/525; 29/559; 52/745.17; 52/122.1; 52/741.1; 52/749.1; 414/23

(58) Field of Classification Search ..... 29/464, 29/466, 468, 525, 559; 52/122.1, 123.1, 52/745.17, 741.1, 749.1, 111, 114, 720.1, 52/726.4; 414/23; 254/134.3 PA
See application file for complete search history.

(56) References Cited

U.S. PATENT DOCUMENTS 1,758,830 A * 5/1930 Bushnell ..... 52/123.1
3,112,830 A * 12/1963 Podlesak ..... 414/23
4,092,079 A * 5/1978 Swanson ..... 403/306
4,327,534 A * 5/1982 Mastalski et al. ..... 52/122.1
4,697,959 A * 10/1987 Kinnan ..... 405/232
5,794,387 A * 8/1998 Crookham ..... 52/122.1
5,944,452 A * 8/1999 Reinert, Sr. ..... 405/232
6,151,860 A * 11/2000 Reisdorff ..... 52/651.02
6,340,790 B1 * 1/2002 Gordin et al. ..... 174/45 R
6,398,392 B2 * 6/2002 Gordin et al. ..... 362/431
6,494,515 B1 * 12/2002 Kalbfleisch ..... 294/86.41
6,550,128 B1 * 4/2003 Lorenz ..... 29/464
6,709,215 B1 * 3/2004 Sorensen ..... 414/23
2003/0089073 A1 * 5/2003 Enns ..... 52/745.17
2005/0120539 A1 * 6/2005 Tutt et al. ..... 29/466

* cited by examiner

*Primary Examiner*—Essama Omgba
(74) *Attorney, Agent, or Firm*—Adam H. Jacobs

(57) ABSTRACT

To erect metal utility poles, a plurality of tubular sections of utility poles are fabricated, each having tapered portions and the diameter of one being slightly larger than the diameter of another. The sections are brought to a site for erection and pulled together with short repeated strokes of a hydraulic cylinder attached to one section with its piston rod connected to another section of utility pole. In one embodiment it is not necessary to manually adjust the mechanism pulling the sections of utility poles together and in another embodiment, a light flexible cord is attached to one section and a hydraulic cylinder to another section. The hydraulic cylinder pulls the cord and when the piston rod is extended for the next retraction, the cord length is adjusted.

9 Claims, 12 Drawing Sheets

UTILITY POLE ASSEMBLY METHOD AND APPARATUS

CROSS-REFERENCE TO RELATED APPLICATION

This continuation application claims priority to the filing date of related non-provisional patent application Ser. No. 10/002,770 filed on Nov. 15, 2001.

BACKGROUND OF THE INVENTION

1. Technical Field

This invention relates to the assembly and erection of utility poles.

2. Description of the Prior Art

Metal utility poles generally are tubular and may take any general tubular shape but are usually cylindrical or octagonal. They are usually fabricated in sections for efficiency in the fabrication process and ease of transportation. After the sections are fabricated, they are attached one to the other for a longer pole. Some such poles have been attached at the utility pole fabricators and then the assembled poles transported to the utility for erection. However, this has the disadvantage of requiring the shipping of over-length utility poles and of handling very heavy utility poles. Consequently, some utility poles are shipped in sections to the site, assembled and erected. For ease in assembly, the sections of a utility pole are tapered and the upper sections are inserted into the bottom sections with sufficient force so that they do not come apart when being erected since if the bottom section dropped out when the pole is being pulled vertically it could result in injury to the personnel as well as damage. Accordingly, the sections must be pulled together with considerable force under standards that are set by the manufacturer to ensure they will not come apart.

In one technique for pulling the utility pole sections together, hydraulic cylinders are attached on opposite sides of a first section of utility pole and corresponding brackets are attached to a second section that is dimensioned to fit into the first section. The hydraulic cylinders and tug brackets are bolted to the sections of utility pole, using nuts provided by the manufacturer. The first and second sections contain a taper selected by pole fabricator to provide a fit that becomes increasing tight as the sections are pulled together. The manufacturer selects the taper and publishes the relationship between force needed to compress the two sections together and the distance the upper section is telescoped over the lower section. A tug arm connects the piston rods of the hydraulic cylinders with the corresponding brackets. The tug arm is pulled by the hydraulic cylinders to pull the poles together in an assembly operation and pushed by the hydraulic cylinders to disassemble sections.

One prior art type of hydraulic cylinder has a stroke sufficiently large to pull the sections together with sufficient force for fastening. Other prior art hydraulic cylinders have shorter strokes. However, the prior art arrangements utilizing relatively short stroke hydraulic cylinders use a heavy steel ladder-typed member to connect the hydraulic piston on one section to the bracket on the other. The sections are pulled together in increments and between increments, the steel ladders are manually adjusted to a new location on the bracket so that the sections can be pulled another increment.

This prior art arrangement has several disadvantages, such as for example: (1) it is heavy and difficult to move; (2) it requires a time consuming and difficult operation in adjusting the position of the ladder-type bracket; and (3) it is relatively expensive.

Accordingly, it is an object of the invention to provide a novel apparatus and method for erecting metal utility poles.

It is further object of the invention to provide a novel apparatus and method for assembling the sections of a utility pole.

It is a still further object of the invention to provide a novel method of assembling and erecting utility poles that is less expensive and less time consuming than prior art systems.

It is a still further object of the invention to provide economical equipment for assembling sections of a utility pole.

It is still further object of the invention to provide equipment which is relatively light and easier to transport than prior art equipment for assembling the sections of utility poles.

It is a still further object of the invention to provide equipment that cooperates with existing equipment normally at a utility pole erection site to assembly utility poles.

SUMMARY OF THE INVENTION

In accordance with the above and further objects of the invention, sections of metal utility pole are fabricated and brought to a site in sections along with a novel apparatus for assembling the sections at the site. The apparatus for assembling the sections of the utility pole include a source of hydraulic power, hydraulic cylinders, brackets and a connecting arm, which are designed to be easily carried. The hydraulic cylinders are mounted on opposite sides of a first tubular utility pole section and corresponding brackets are mounted to opposite sides of a second utility pole section that is to be pulled into the first section. While the terms "bracket" or "tug bracket" are used in this specification, other means for permitting a connection between the two sections to be pulled together can be used such as a single member fastened in a single hole in the section. A tug arm is connected between the hydraulic cylinder sections and the tug bracket and used to transfer force between the hydraulic cylinders and their corresponding tug brackets to pull the sections together. While the term "tug arm" is used in this specification, any other means for easily permitting the transfer of force from the hydraulic cylinder to the tug bracket can be used such as a ladder configuration of a flexible cord type structure at least for the assembly operation.

In the preferred embodiment, the tug arms have teeth with the forward side having cam surfaces on them and the rearward sides having a straight surfaces that engage corresponding surfaces on the tug bracket. With this arrangement, the tug arm is lifted when the cam forward surface of a tooth engages the tug bracket during an extension stroke of the hydraulic cylinder to be lifted up over the extending surface on the tug bracket and then drops over it so that the rearward locking surface of the tooth is locked in position with a corresponding locking surface of the bracket. In this specification the terms "locking surface" or "straight surface" or "ratchet member" are used but any surfaces that permit the pulling operation without moving the arm away from matching rearward surface of the tooth may be used. During the retraction stroke of the hydraulic cylinder, the reward straight surface of the tug arm tooth engages a straight surface on the tug bracket to pull the bracket and second utility pole section one increment in the direction of the first section. After this retraction, the cam surface of the next tooth on the tug arm is positioned to engage the straight surface of the bracket for the first lifting operation of the next increment. To disassemble a utility pole into its sections, the tug arm is reversed so that the cam surface lifts the tug arm tooth over the tug bracket during the retraction of the hydraulic cylinder piston rod and pushes with the straight side of the tooth engaging a straight surface of the bracket during the extension part of the cycle of the hydraulic cylinder operation.

In the preferred embodiment, the operation of the hydraulic cylinder, tug arm and bracket are analogous to a rachet mechanism with a plurality of ratchet pawls on the tug arm and single member rack. The pawls have a substantially saw tooth shape but could have any other workable cam shape or the rack member could contain the cam surface and the teeth of the tug arm have only straight surfaces. In other embodiments, the tug arm may only have one tooth and there may be a plurality of members on bracket in the member of a rack using one pawl. Similarly, a plurality of members such as in the case of a ladder configuration could be used instead of a single arm with teeth on it. Morever, the tug arm may be mounted to cam to the side of the utility pole section and be pulled back by a leaf spring instead of being cammed upwardly and falling by gravity. With a ladder-type mechanism the rungs may be made to have great tensile strength such as the case of reinforced fabric but to be light and easily moveable and the camming operation may be performed with the light rungs being moved or with the side members having the cam surfaces or cam follower surfaces.

In still another embodiment for assembling the sections, the tug arm may be a flexible member fastened at different lengths to the piston rod of the hydraulic cylinder but because it is a flexible member that change may be made easily, such as for example having a plurality of loops to be attached to the extended hydraulic cylinder so as to pull in tension the sections together to a retracted position of the hydraulic piston, where a different position on the flexible member is attached to the same detent on the piston arm. In this embodiment, one or more cord type apparatus may be used for assembly section of a utility pole to be erected and an separate type of apparatus may be dedicated for disassembly of utility poles.

In operation, the sections of the utility pole are fabricated with nuts welded on them for the attachment of the bracket for the hydraulic cylinder and the tug bracket. Trucks are loaded with the sections. Sections of the same length may be loaded on one truck to be dropped off at a plurality of sites and sections of another length to be used, perhaps at a higher location and have a smaller diameter are loaded on another truck to be dropped off at sites where the matching sections are already located. On the other hand, a truck may be loaded with the sections for a single site and brought to the site. Generally, the sections are tapered for easy assembly together at a controllable pressure that can be measured by the amount of overlap between sections after they are pulled together.

A conventional digger derrick truck as normally used in the erection of wooden telephone poles or metal telephone poles and trucks containing the sections of utility pole are driven to the site. The appropriate sections are then dropped off and the truck may move to a new site. The utility company digger derrick trucks pick up the sections, by a sling mounted at the center of gravity of the section and move them into position with the ends to be combined facing each other. One section lies on the ground, with a support lifting its end slightly. The other section is moved by the crane from its center of gravity and started into the first section.

The hydraulic cylinder hoses may be connected at any time to a source of hydraulic power within the truck or connected to a separate source of hydraulic power. The cylinders are mounted to cylinder brackets and the brackets are mounted on opposite sides of the section, utilizing the nuts already welded on the sections by the fabricator. The tug brackets are fastened to the matching end of the other section and the tug arms may be lifted and carried for positioning to the hydraulic piston and on the tug bracket with a gudgeon. The hydraulic cylinder is then operated in a series of extension and retraction cycles, with each cycle being of sufficient length so that the cam surface of the tug arm the tug arm drops with its catching surface on the corresponding catching surface of the tug bracket. A retraction cycle then incrementally pulls the sections together. After they are pulled together with sufficient force, the crane erects the entire pole in place in a manner known in the art for utility poles. The tug arm can be reversed to disassemble sections if needed.

In making the apparatus for pulling the sections together, the size of hydraulic cylinder is selected in accordance with the hydraulic pressure that is readily available. For very large sections of large utility poles, more pulling force is needed and a larger cylinder is used to enable a convenient source of hydraulic fluid to be used. The most convenient source of hydraulic pressure is usually the conventional digger derrick truck used by many utility companies but of course other units can be used. An efficient size of increment is selected in accordance with the cylinder size and the hydraulic pressure source to minimize the time for pulling the sections together. The brackets and tug arm are fabricated for easy attachment of the brackets to sections of the utility pole and easy connection to the tug arm for efficient operation in the field.

From the above description, it can be understood that the method and apparatus of this invention for erecting utility poles has several advantages, such as: (1) it is faster and more poles can be erected by the same team in less time than the prior art methods; (2) the equipment is light and inexpensive, being easily moved; and (3) it is safer to use than the prior art equipment.

BRIEF DESCRIPTION OF THE DRAWINGS

The above noted and other features of the invention will be better understood from the following detailed description when considered in conjunction with the accompanying drawings in which.

DESCRIPTION OF THE PREFERRED EMBODIMENT

Figure 1:
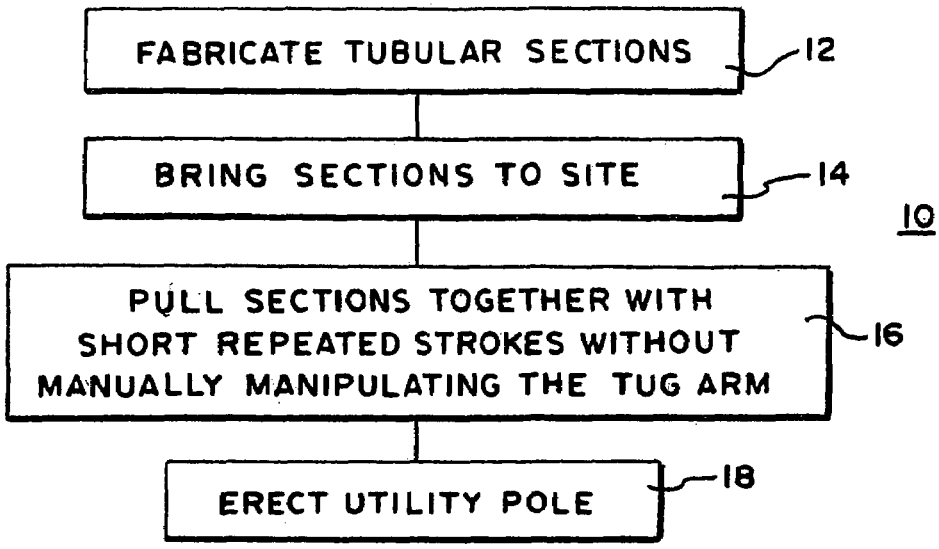
FIG. 1 is a flow diagram illustrating a novel method of erecting utility poles.

In FIG. 1, there is shown a flow diagram of a process 10 of erecting utility poles in accordance with an embodiment of the invention comprising the step 12 of fabricating tubular sections of the utility pole, the step 14 of bringing sections to the site at which the utility pole is to be erected, the step 16 of pulling sections together with short repeated strokes without manually manipulating the pull arm that is pulling the sections together and the step 18 of erecting the utility pole.

Using these steps, trucks may be loaded at the fabrication site of the tubular sections of the utility poles with tubular sections and brought to the site for erecting the utility poles at which the site the appropriate sections may be placed. Trucks, commonly called digger derrick trucks by utility pole installers, contain a derrick for lifting the sections and placing them end to end in a position and a source of hydraulic pressure so that the uppermost metal tapered columns may be inserted into the top of the lower, larger diameter metal tapered columns and pulled together with sufficient pressure so that they do not during erection or during use come apart. The pulling may be done hydraulically so as to tighten them to the specified separation force. The sections are tapered for this purpose and contain openings formed by the fabricator to enable the sections to be pulled together conveniently.

The sections are pulled together by a number of short strokes so that the work can be done by relatively short stroked, less-expensive, and lighter-weight hydraulic units. The hydraulic pressure for such short stroke hydraulically driven pistons can be supplied by the digger trucks, thus rendering the operation still more convenient and cheaper. The size of the hydraulic cylinder is chosen to convert the available hydraulic pressure to the required pulling or pushing force. Since the time to make a stroke becomes longer as the force becomes greater, a compromise between the time of the stroke and the convenience of using hydraulic pressure from the readily available digger derrick trucks rather than a larger stand alone source of hydraulic pressure may be necessary.

Figure 2:
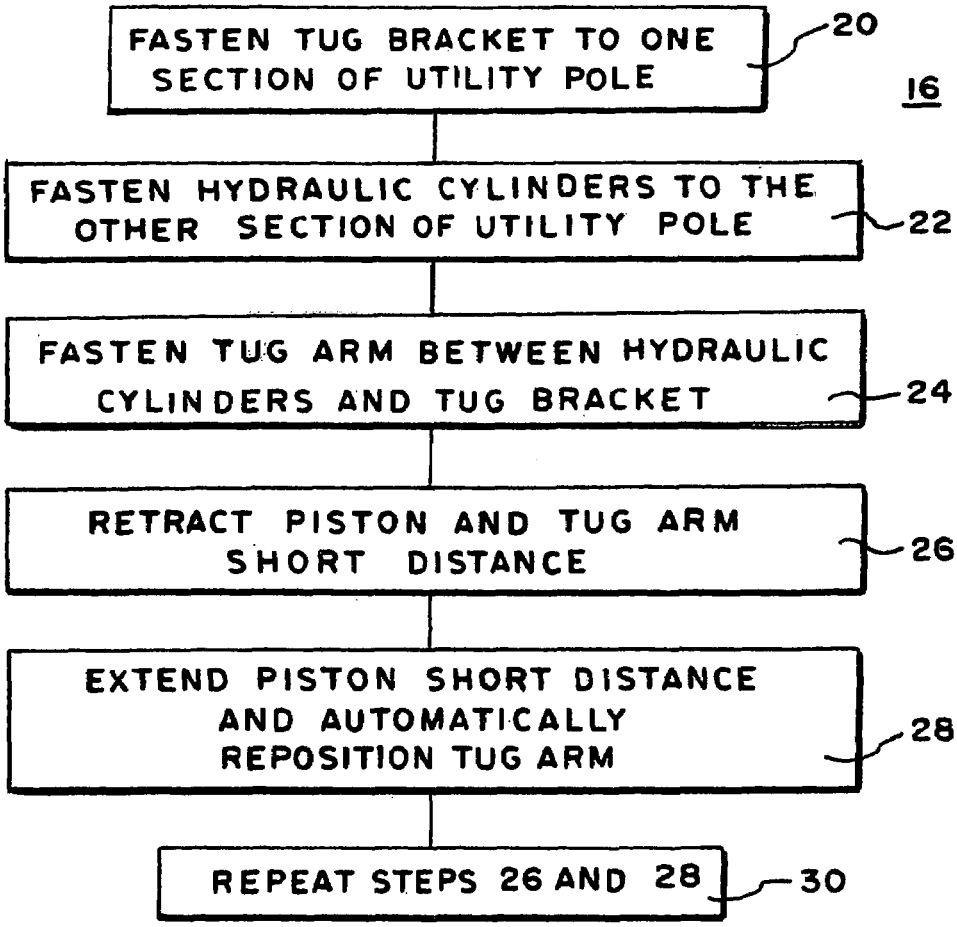
FIG. 2 is a block diagram of the step of pulling sections of a utility pole together in accordance with the process of FIG. 1.

In FIG. 2, there is shown a flow diagram of the process 16 of pulling the sections together with a plurality of short strokes without manually resetting or manipulating the tug arms between each stroke comprising the step 20 of fastening a tug bracket to one section of utility pole, the step 22 of fastening hydraulic cylinders to the other section of utility pole, the step 24 of fastening the tug arm between the hydraulic cylinders and the tug bracket, the step 26 of retracting the piston and the tug arm a short distance to pull the two sections together, the step 28 of extending the piston a short distance and automatically repositioning the tug arm and the step 30 of repeating steps 26 and 28 until the sections are pulled together sufficiently tight so they will not come apart when erecting the utility pole. Generally, the step of fabricating the poles includes the step of fabricating poles that are in the range of 75 feet to 110 feet long. The hydraulic pressure in the preferred embodiment is for the most common place sizes of utility poles and thus is generally in the range of 2,000 psi but can be much higher and lower depending on the pressure that has to be applied. The hydraulic cylinder brackets have holes drilled in them that match the holes on the fabricated utility poles. Those holes generally are at thirty inch centers and permit one inch bolts to be screwed into the one inch nuts that are welded onto the pole by the pole manufacturer.

The step of fastening the tug bracket to one section includes the step of threading one inch bolts through holes thirty inches on center in the tug bracket into the thirty inch on center openings in the section of utility pole and more specifically into the one inch nuts welded to the utility pole. Similarly, the hydraulic cylinders are each mounted to a bracket with thirty inch holes on center and the step of mounting the cylinders to the other section of pole includes the step of threading the one inch bolts through corresponding thirty inch on center openings with one inch nuts welded on center with them for the utility pole.

The actual pulling force of two hydraulic cylinders pulling on two sides of the sections is approximately forty thousand pounds but only needs to be sufficient to pull the sections together. Moreover, by selecting different sizes of hydraulic cylinders the maximum pulling or pushing force can be selected. Clevises are mounted at the ends of the hydraulic piston rods for mounting to the tug arm to permit motion in a direction that permits self adjusting of the teeth on the tug arm to the tug tube by moving the tub arm over the tug tube to engage the tug tube in the tug lock. In the preferred embodiment the tug arms are seven feet long and have on each end an opening and end bushings that fit the clevis to limit side to side movement of the tug arm when attached to the hydraulic cylinder clevis. The bushings have a one inch hole to permit them to be pinned to the clevis on the piston rods of the hydraulic cylinders. The stroke of the piston in its retraction and extension positions is approximately ten inches and the teeth that it grips on the tug arm where the tug arm has the rachet mechanism are correspondingly spaced ten inches apart with their gripping surface. Cam surfaces are provided between the teeth or on the tug bracket engaging member to permit the tug arms to automatically be lifted above the member of the tug arm and lock on its opposite side for retraction and pulling the sections together and then follow with a stroke in which it moves forward, is cammed over the tug arm engaging member and locks in place for another retraction.

Figure 3:
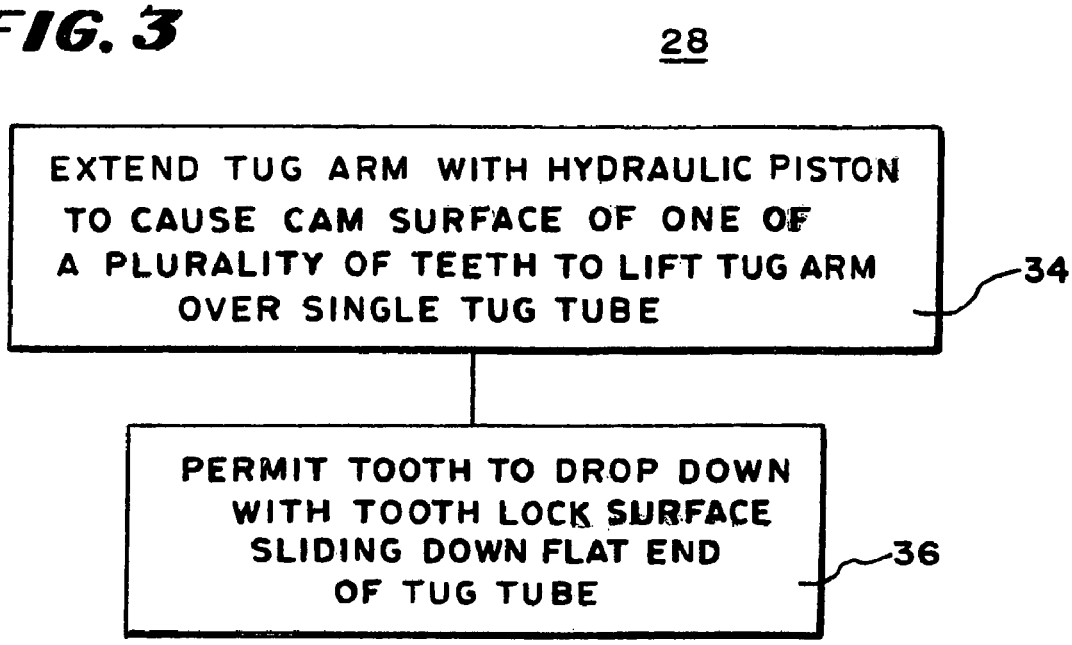
FIG. 3 is a flow diagram of the process of automatically repositioning a pull arm and tug bracket with respect to each other in accordance with an embodiment of the invention.

In FIG. 3, there is shown a flow diagram illustrating the process 28 (FIG. 2) including the step 34 of extending with a hydraulic piston the tug arm, which has a series of teeth on it, until a cam surface on the forward end of the teeth on the tug arm engages the tug tube on the tug bracket which is stationary and flat to cause the cam surface on the tooth to lift the tug arm over the flat side of the tug tube, and the step 36 of continuing the forward movement until the locking surface on the other (rearward) side of the tooth gets to the end of the tug tube which is also flat and again slides downwardly so that the locking surface of the tooth abuts the flat end of the tug tube. In this position, the equipment is ready to start a new cycle by retracting the piston and tug arm to pull the tug tube toward the piston as shown in step 26 of FIG. 2 and move the upper section of the utility pole one increment further into the bottom section.

Figure 4:
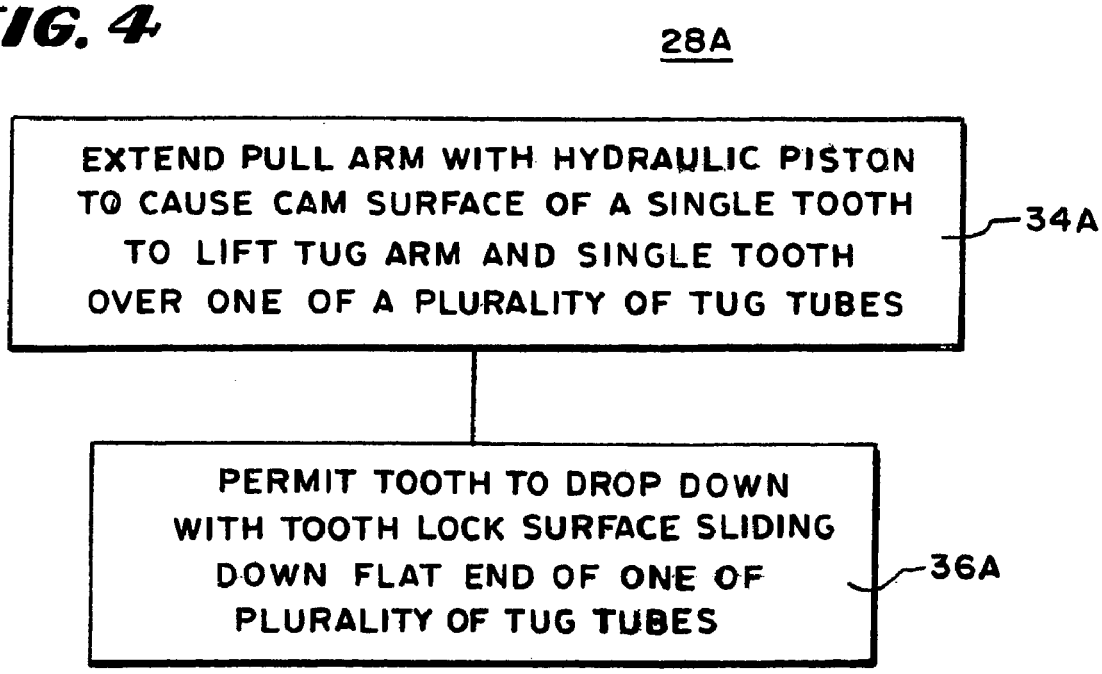
FIG. 4 is a flow diagram of another embodiment of repositioning a pull arm and tug bracket with respect to each other in accordance with the invention of FIG. 1.

In FIG. 4, there is shown a flow diagram of another embodiment 28A of extending the piston a short distance and automatically repositioning the tug arm including the step 34A of extending, with the hydraulic piston, the tug arm with a single tooth on it until the forward end of the single tooth with a cam surface engages the of one of a plurality of tug tubes on the tug bracket to cause the cam surface of the tooth on the tug arm to lift the single tooth and tug arm over one of a plurality of tug tubes on the tug bracket until the locking surface of the tooth can slide downwardly against the flat side of the tug tube and the step 36A of permitting the tooth and tug arm to drop down with the locking surface sliding down the flat end of a tug tube on the bracket. At this point just as in the embodiment 28 the apparatus is ready to retract the hydraulic piston to pull the one section further into the other section by one increment. As can be understood from the foregoing description, this is a process similar to the process of step 28 (FIG. 3) but the positions of the rachet teeth, which are tug tubes in this case, and cooperating pawl, which is a tooth in this case, are reversed. In both the process of FIG. 3 and the process of FIG. 4, a cam surface is used to move a tug arm with respect to a ratchet and permit a pawl to engage the ratchet.

Figure 5:
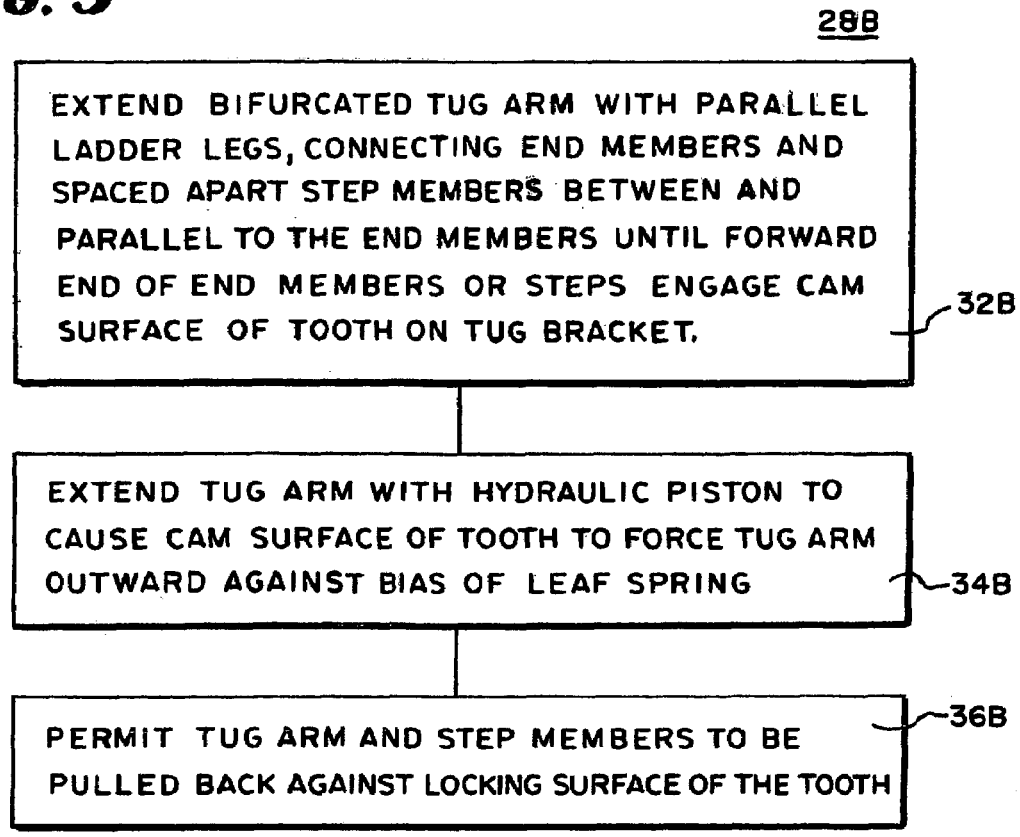
FIG. 5 is still an other embodiment of a process of repositioning a tug arm and tug bracket with respect to each other in accordance with one step of the embodiment of FIG. 1.

In FIG. 5 there is shown still another embodiment 28B for automatically repositioning the tug arm having the step 32B of extending the bifurcated tug arms with parallel elongated legs and end members orthogonal with step members between them that are in the manner of a ladder: (1) spaced apart from each other between the upper and lower end members; and (2) orthogonal to the legs between upper and lower parallel end members. The bifurcated arms are extended until the forward end of an end member or step engages a cam surface of a tooth on the tug bracket. After the step 32B, the step 34B of extending the tug arm with a hydraulic piston to cause the cam surface of the tooth to force the tug arm outwardly and sideways from the utility pole against the bias of a leaf spring pulling it toward the utility pole and the step 36B of permitting the step to be pulled back by the leaf spring against the locking surface of the tooth are performed so as to be in position for another increment of retraction. This process differs from the processes 28 and 28A (FIGS. 3 and 4) in that it cams the tug arm outwardly away from the utility pole to move a tug member on the tug arm to move over a tooth on the tug bracket.

Figure 6:
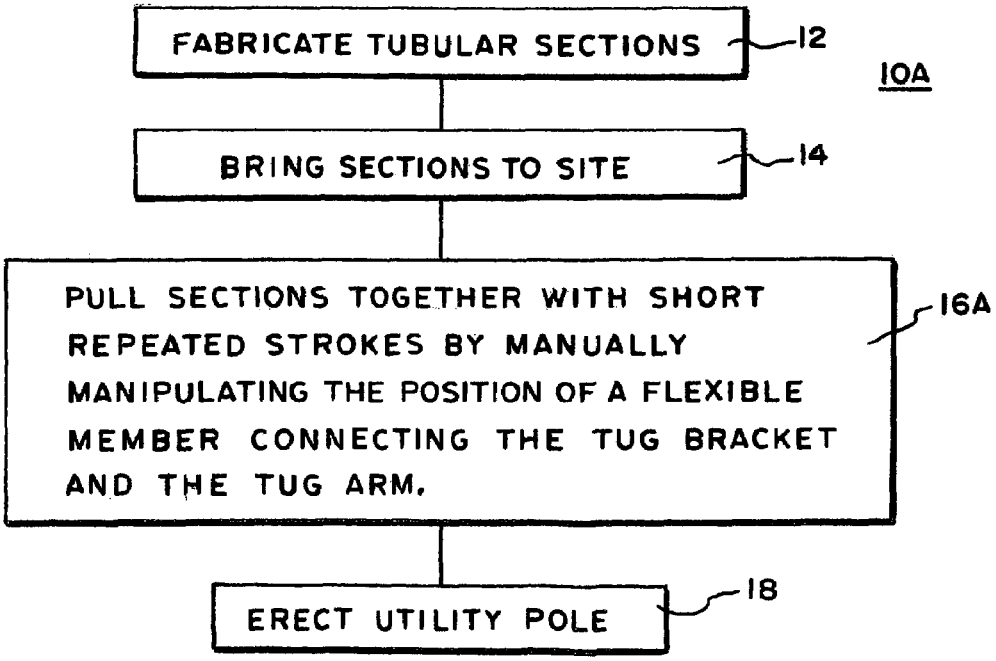
FIG. 6 is a block diagram illustrating another method of erecting utility poles.

In FIG. 6 there is shown another embodiment 10A of a process of erecting a utility pole, having some steps that are the same as in the embodiment 10 of FIG. 1. The steps that are substantially the same between the process 10 and 10A are indicated by the same reference numbers and the steps that differ have the suffix "A" added to them. This process includes the step 12 of fabricating tubular sections of utility poles, the step 14 of bringing sections to the site, the step 16A of pulling the sections together with short repeated strokes by manually adjusting the position of a cord connecting the bracket and the piston rod of the hydraulic piston and the step 18 of erecting the utility pole.

Figure 10:
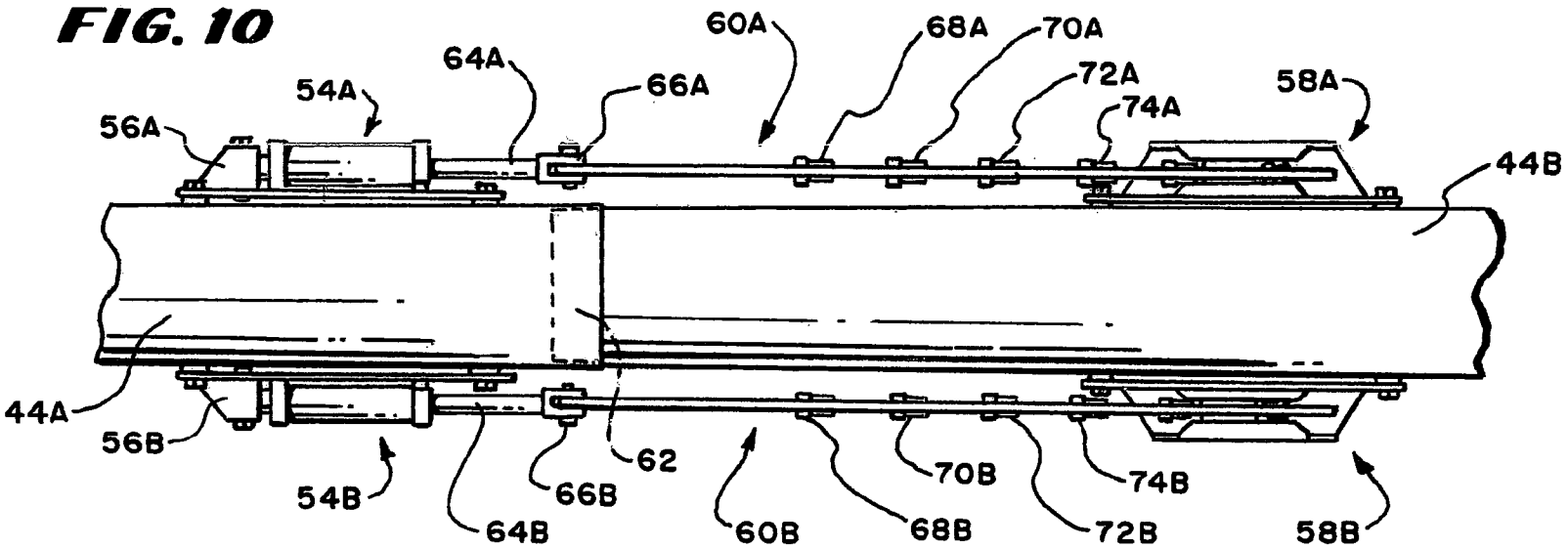
FIG. 10 is a fragmentary plan view of the apparatus of FIG. 9 in one stage of operation.

The step 16A utilizes two cylinders, a tug cord and a tug bracket in a manner similar to that of the embodiment of FIG. 10. However, instead of a tug tube being mounted on the tug bracket and rigid teeth on a tug arm, a cord is attached to the tug bracket on each side of the sections and contains a number of different positions to which the other end of the cord can be attached to the tug arms or a number of different loops or fastening positions on the cord that permit it to be shortened. In this embodiment, the piston is extended and the cord connected to the tug arm so that it is tight. The pistons are then retracted and the sections pulled together. At this point, the cord is removed from its position on the tug arm or a different loop of the cord is selected and attached. The cord can be a thick nylon member which is flexible or composite materials that have sufficient strength in tension as known in the art.

Figure 7:
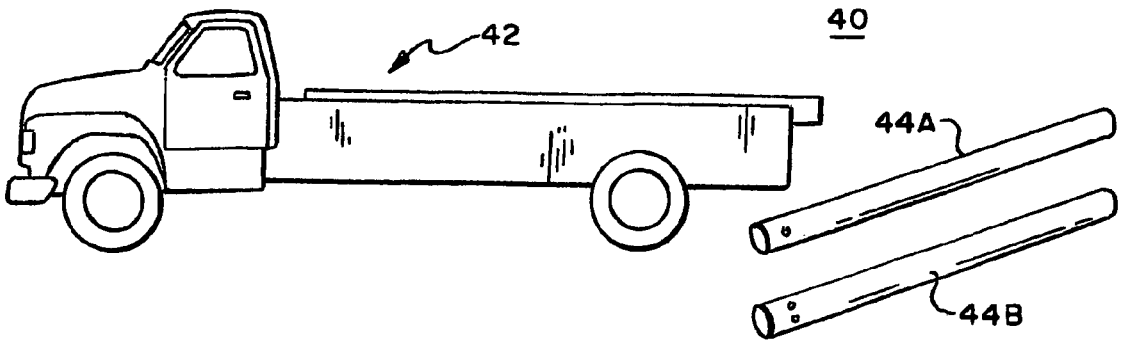
FIG. 7 is a schematic diagram illustrating one step in the process of FIG. 1 or FIG. 6.
Figure 8:
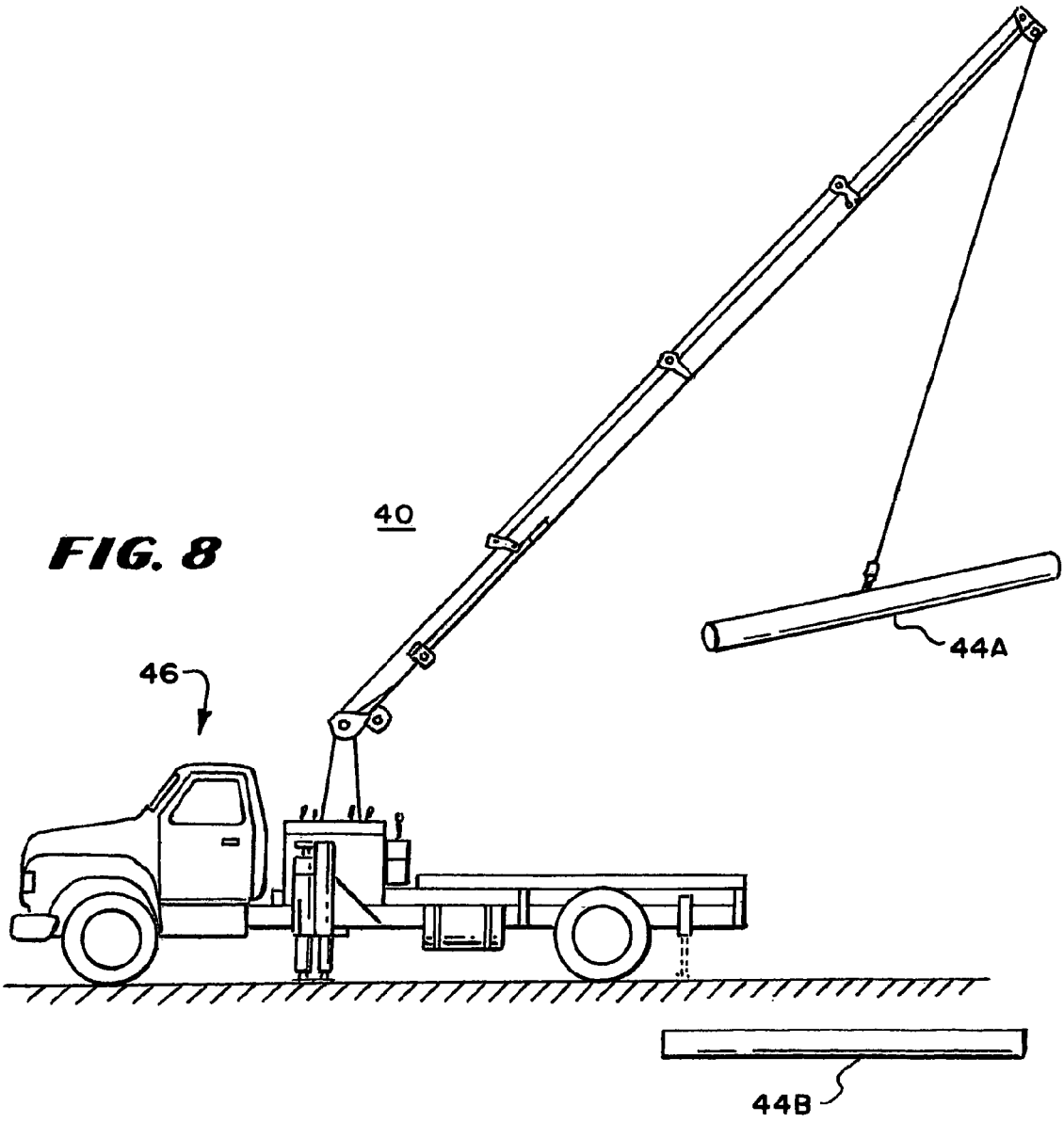
FIG. 8 is a schematic drawing illustrating a second step in the processes of FIG. 1 and FIG. 6.

In FIG. 7, there is illustrated equipment at a site 40 including a truck 42 having a bed sufficiently long to carry a plurality of sections such as 44A and 44B of utility poles. The sections of utility poles are tapered so that upper sections may fit within bottom sections and pull together with a sufficiently tight press so they will not fall apart. They are loaded into trucks at the fabricator and carried to the site and unloaded there. As illustrated in FIG. 8, a digger derrick truck 46 is also brought to the site 40. A source of hydraulic pressure for hydraulic pistons must also be brought to the site, but in the preferred embodiment, the conventional digger derrick truck is equipped with hydraulic hoses, a hydraulic pump and hydraulic fluid under sufficient pressure to pull sections of utility pole together. Thus the derrick can be used to position the sections with the ends to be pulled together adjacent. The bottom section which is of slightly larger diameter will rest upon an elevating member which may be a 2×4 lumber or the like and the other section is held by the derrick about its center of gravity so that it is easily balanced and may be started into the stationary section.

Figure 9:
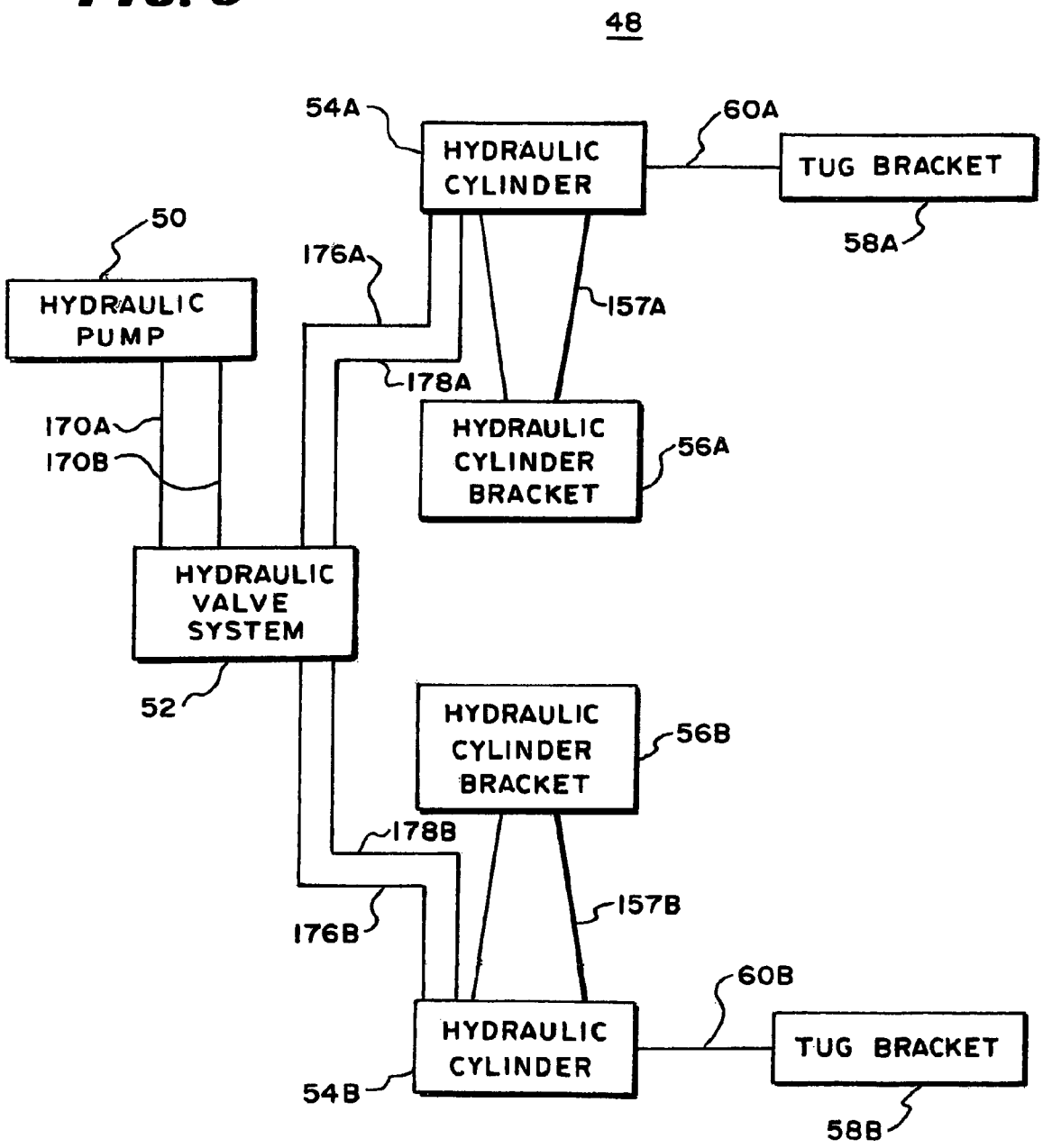
FIG. 9 is a block diagram illustrating the apparatus for pulling sections of a utility pole together.

In FIG. 9, there is shown a block diagram of the system 48 for pulling utility poles together including a hydraulic pump 50, a hydraulic valve system 52, two hydraulic cylinders 54A and 54B, two hydraulic cylinder brackets 56A and 56B, two tug brackets 58A and 58B and two tug arms 60A and 60B. As shown in this view, the hydraulic pump 50 supplies hydraulic fluid under pressure to the hydraulic valve system 52 which contains a valve system for extending the piston arm or retracting the piston arm of hydraulic cylinders 54A and 54B. The hydraulic cylinders 54A and 54B are mounted to the corresponding cylinder brackets 56A and 56B which in turn are mounted to opposite sides of a first section of utility pole and the tug brackets 58A and 58B are mounted to opposite sides of a second section of utility pole that is to be pulled into the first section.

In one form of the embodiment of FIG. 9, the hydraulic cylinders 54A and 54B are connected to respective ones of the tug brackets 58A and 58B by corresponding ones of the tug arms 60A and 60B so that as the hydraulic cylinder piston rods are retracted, the tug arms 60A and 60B pull the two sections of utility pole together and as the piston rods are extended, the tug arm is reset. In this form of the embodiment of FIG. 9, the tug arm can be reversed to be attached at its other end and it operates to push sections of a utility pole apart during extension of the piston rods and resets during retraction of the piston rods. In another form of the embodiment of FIG. 9, a more flexible member is used as the tug arm and in this embodiment a flexible member is attached at one end to the tug bracket and at the other end is attached to the piston rod. However it can be attached at any of a plurality of locations on the cord so it can pull one increment of utility pole section into another section and then the cord can be loosed by extending the piston rods and fastened at another location on the cord to pull another increment of section of utility pole into the other section of utility pole.

In both forms of the embodiment of FIG. 9, the hydraulic pump 50 pumps fluid to the hydraulic valve system 52 through hose 170A and receives it through the return hose 170B. In return the hydraulic valve system 52 supplies fluid to the hydraulic cylinders 54A and 54B through the hoses 176A and 176B respectively and receives it through the return hoses 178A and 178B respectively. The hydraulic cylinders 54A and 54B push and pull the tug arms 60A and 60B respectively to push and pull the utility pole sections (not shown in FIG. 9) in conjunction with the tug brackets 58A and 58B.

In FIG. 10, there is shown a fragmentary plan view of a portion of the system 48 (not shown in FIG. 10-*see* FIG. 9) for pulling a first section 44A and a second section 44B of a utility pole together. The sections 44A and 44B are shown started into a position but with portion of a section 62 of the section 44B that is about to be pulled inside the section 44A to provide a tight enough fit. For this purpose, the portion of the system 48 for pulling the sections together shown attached to the section 44A and 44B are the hydraulic cylinder brackets 56A and 56B, the hydraulic cylinders 54A and 54B, the tug arms 60A and 60B, and the tug brackets 58A and 58B shown with the hydraulic cylinders 54A and 54B mounted to the respective brackets 56A and 56B on opposite sides of the section 44A and the tug bracket 58A and 58B being mounted to and on opposite sides of the second section 44B. The tug arms 60A and 60B connect the piston rods 64A and 64B of the respective ones of the hydraulic cylinders 54A and 54B , the corresponding ones of the tug brackets 58A and 58B so that as the piston rods 64A and 64B are retracted, the tug brackets 58A and 58B are pulled toward the section of utility pole 44A, thus pulling the section of utility pole 44B into the section 44A and reducing the size of the area 62.

The ends of the piston rods 64A and 64B are mounted to the tug arms 60A and 60B by respective ones of the devises 66A and 66B, being pinned together to permit upward and downward movement of the tug arms 60A and 60B. As will be further explained hereinafter, the upward movement is caused by a camming action under force generated by the extension of the pistons rods 64A and 64B and the downward motion is by gravity.

Four of six teeth, 68A–74A and 68B–74B on corresponding ones of the tug arms 60A and 60B are shown in FIG. 10 although there are six such teeth in the preferred embodiment. These teeth interact with the tug bracket 58B to lift the tug arms upwardly as the piston rods 64A and 64B are extended and to hold tightly against the tug bars when retracted so that the section 44B can be pulled into the section 44A in a series of incremental steps. This enables the piston to have a shorter stroke and enables less expensive hydraulic equipment to be used without slowing down the process materially.

Figure 11:
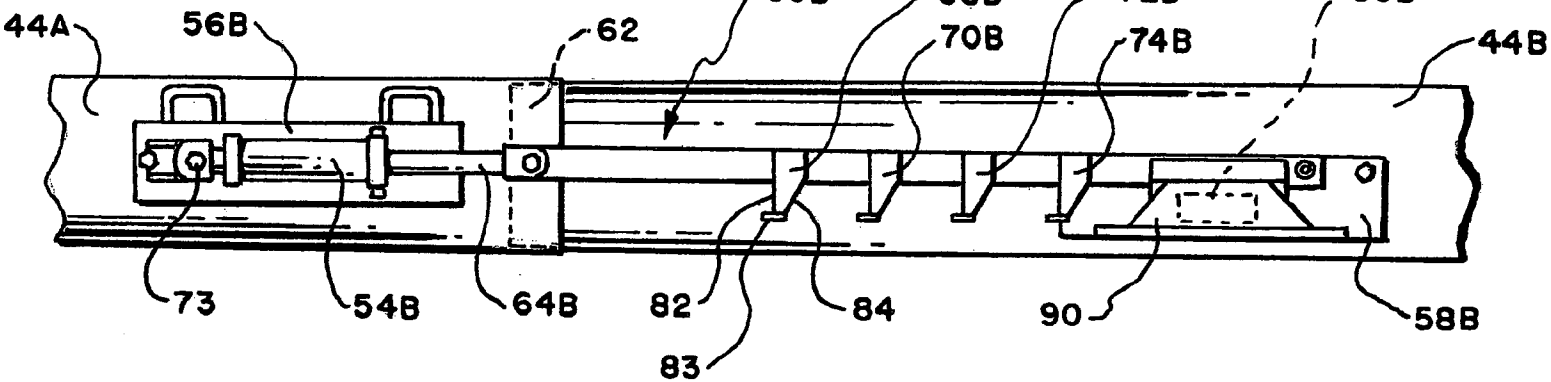
FIG. 11 is a fragmentary side elevational view of the apparatus of FIG. 10 in the same stage of operation.

In FIG. 11, there is a shown a side elevational view of the sections 44A and 44B with the hydraulic pulling apparatus of the embodiment of FIG. 10 attached. As shown in this view, the bracket 56B has the hydraulic cylinder 54B mounted by bolts 73 to it and is in turn bolted to the section 44A at bolting points spaced thirty inches apart. The piston 64B is shown connected by the clevis 66B to the tug arm 60B. The tug arm 60B has six teeth, four of which are shown clearly in FIG. 11 as in FIG. 10. The tooth 68B will be described in detail, with the understanding that the other teeth 68B–78B (76B and 78B not being shown in FIGS. 10 and 11) are constructed in the same manner.

Each of the teeth is fastened such as by welding to the elongated arm 60B and they are spaced from each other approximately 10 inches in the preferred embodiment but are generally spaced apart by the same distance as the length of the piston stroke of the hydraulic cylinder so as to pull the sections together the amount of a piston stroke at each cycle of the hydraulic cylinder. The rearward or trailing side (facing the hydraulic cylinder) of each tooth is straight as shown at 82 and has a bottom plate 83 extending orthogonally at the bottom edge of the straight surface 82 so the straight side 82 and its bottom detent 83 form a locking surface for a bracket tube. The leading or forward edge 84 serves as a camming edge cooperating with a tug tube in the tug bracket 58B. The tug bracket 58B has mounted to it the tug tube 86 and this tube 86 cooperates with the cam surfaces 84 so that as the piston 64 is extended and the tug arm 60B moved against the tube 86, the tug arm 60B is lifted. On the other hand, the locking surface 82 slides down over the opposite end of the tube 86 so that when the hydraulic piston 64B is pulled or retracted, it pulls the tug bracket 58B with it.

Figure 12:
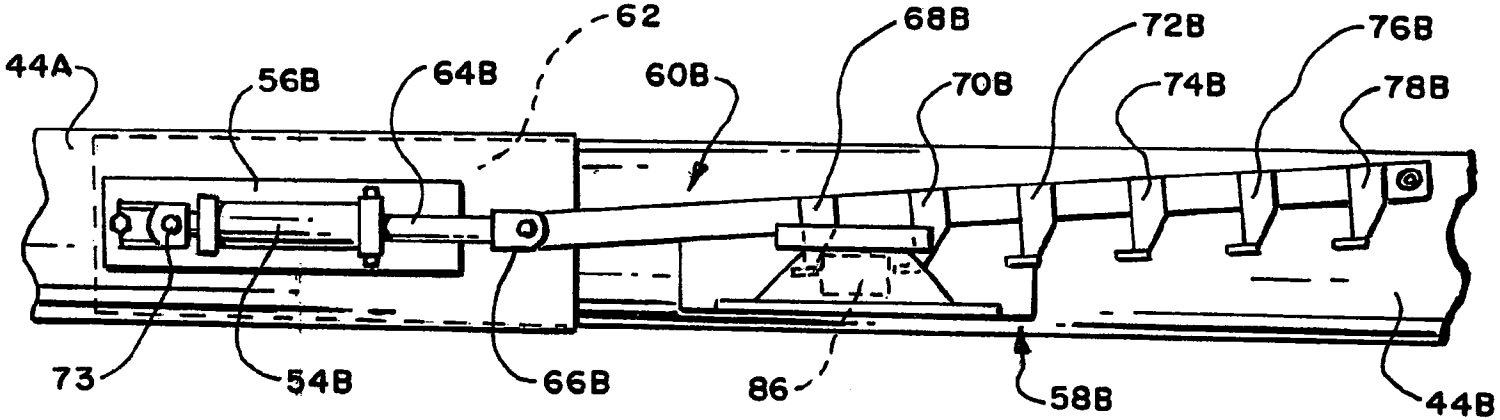
FIG. 12 is a fragmentary side elevational view of the apparatus of FIG. 12 in the second stage of operation.
Figure 13:
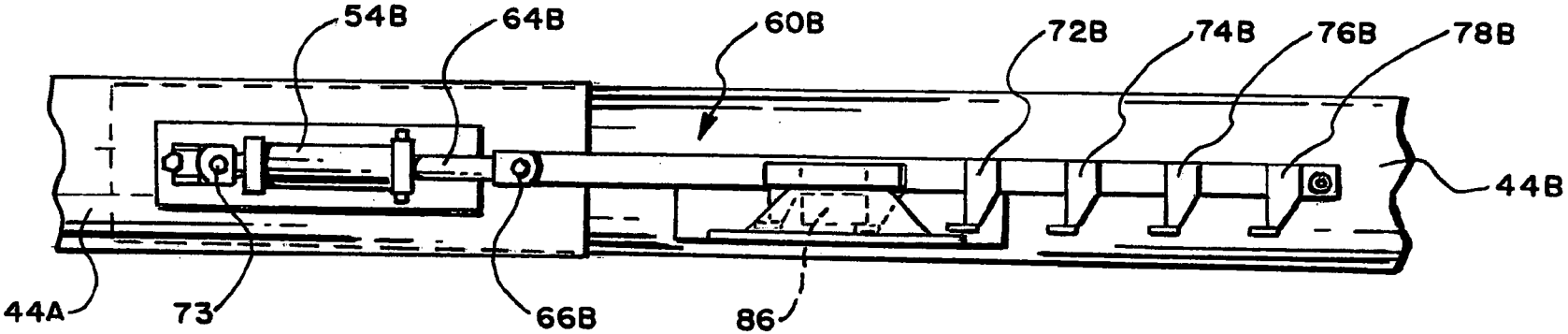
FIG. 13 is a fragmentary side elevational view of the apparatus of FIG. 14 in the third stage of operation.

In FIGS. 10 and 11, the sections of utility pole 44A and 44B are shown at a first stage in which the pistons 54A and 54B have brought a tooth of the tug arms 60A and 60B adjacent to the tug tube 86. In FIG. 12, there is a side view showing the hydraulic cylinder 64B, the tug arm 60B, and the tug bracket 58B in a later stage of repositioning the tug arm. In this later stage, the piston 64B has been further extended so that the cam surface 84 of the tooth 68B has abutted the tube 86 and has been forced further along to cause it to cam the tug arm 60B upwardly. Of course the same process is being followed with the corresponding hydraulic cylinder 64A, tug arm 60A and tug bracket 58A on the other side of the utility pole sections 44A and 44B. While the second stage is shown in conjunction with the tooth 68B, the same function is performed with each tooth as the utility pole sections 44A and 44B are pulled together further and further. In FIG. 13 there again is shown a side elevational view showing the utility pole sections 44A and 44B at the end of a retraction stroke pulling the utility pole sections still further one into the other for a tighter fit. This process is repeated until the poles are completely pulled together with sufficient force so they will not unintentionally come apart.

Figure 14:
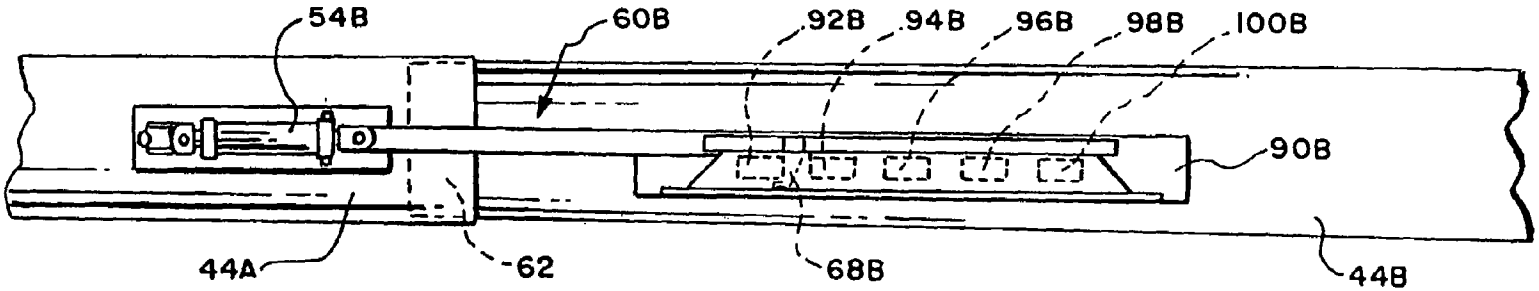
FIG. 14 is a fragmentary side elevational view of another embodiment of apparatus for pulling together sections of a utility pole.

In FIG. 14 there is shown a fragmentary side elevational view of two utility pole sections 44A and 44B being pulled together by another embodiment of apparatus for pulling together sections 44A and 44B. Many of the parts of the embodiment of FIG. 14 are the same as the embodiment of FIGS. 10–12 in which similar parts are labeled with the same reference number. In the embodiment of FIG. 14, the tug brackets 90A and 90B (90B only being shown in FIG. 14) are elongated and include a plurality of tug tubes 92A–100A and 92B–100B (only 92B–100B being shown in FIG. 14 as an example), six tug tubes being used on each side in the preferred embodiment although an appropriate number can be picked for any size camming arrangement. The tug arm has a single tooth 68B which, when pushed forward lifts the tug arm upwardly as it rides up the cam surface of a tug tube and then permits it to drop by gravity downwardly so as to engage the tug bracket. When the piston is retracted, it will pull the sections through in one increment in a manner directly analogous to the embodiment of FIGS. 10–13.

Figure 15:
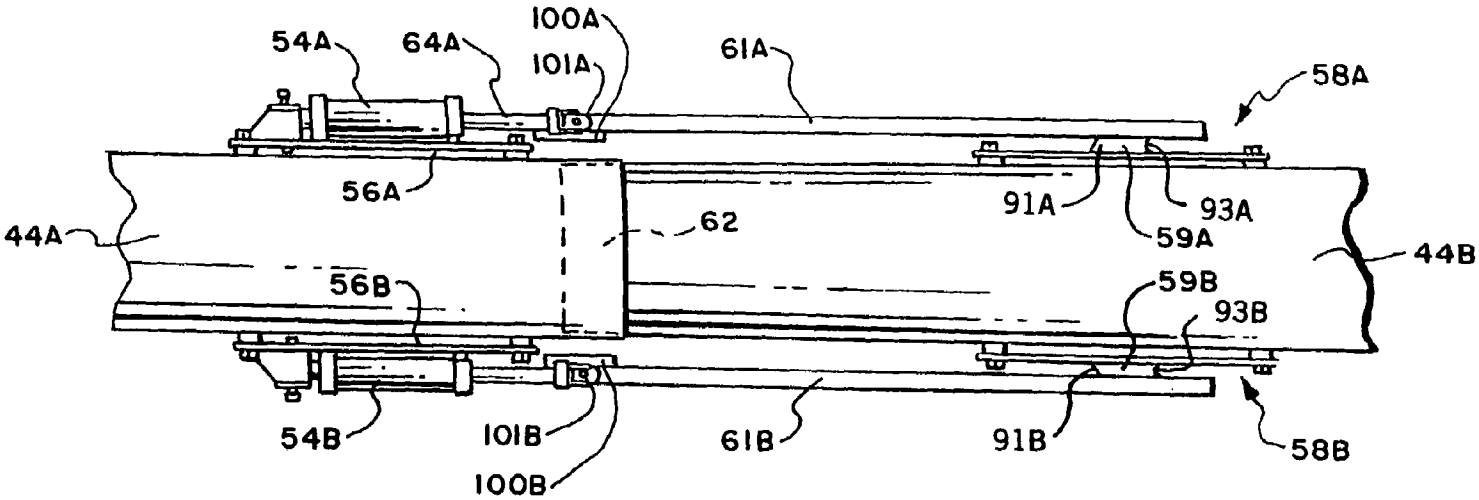
FIG. 15 is a plan view of still another embodiment of apparatus for pulling sections of a utility pole together.
Figure 16:
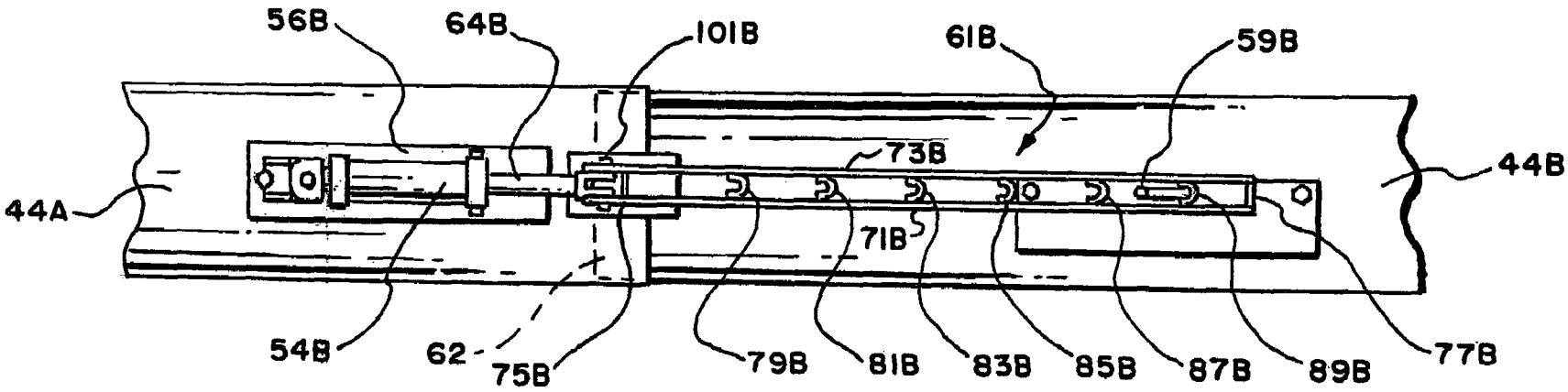
FIG. 16 is a fragmentary side elevational view of the embodiment of FIG. 15.

In FIGS. 15 and 16, there is shown a plan view and a side elevational view of still another embodiment having parts similar to those of the previous embodiments of FIGS. 10–14 except that the tug arms 61A and 61B are bifurcated, ladder like and structured to be moved outwardly from the sides and biased back by a leaf springs 100A and 100B, respectively. As shown in the plan view of FIG. 15, the tug brackets 58A and 58B each have a single tug member 59A and 59B projecting outwardly to the sides with a sloped rearward surface 91A and 91B (facing the hydraulic cylinders 54A and 54B) and a locking forward surface 93A and 93B. The tug arms 61A and 61B as best shown in conjunction with the tug arm 61B in FIG. 16 each have two legs 71B and 73B, two end members 75B and 77B and a plurality of spaced apart legs 79B, 81B, 83B, 85B, 87B and 89B, parallel to each other and to the end members and substantially orthogonal to the legs.

Figure 17:
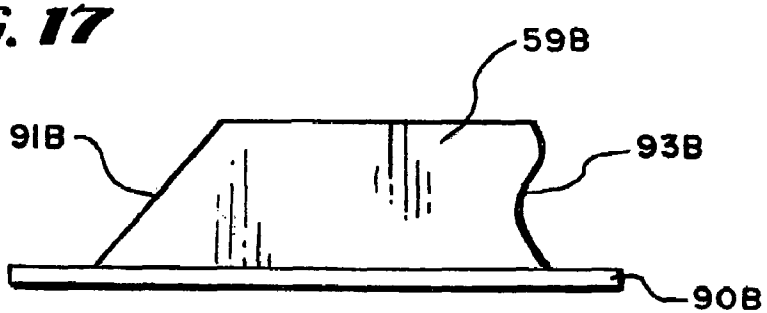
FIG. 17 is an elevational view of a portion of the embodiment of FIGS. 15 AND 16 referred to as a tug tube.

The sloped surfaces 91A and 91B engage legs on the tug arm and pull the tug arms outwardly at which time they snap back against the locking surface. The devises 101A and 101B are mounted to permit sideways movement away from the utility pole sections and the leaf springs 100A and 100B provide a bias back toward the side of the utility pole sections. Any suitable biasing method could be used instead of leaf springs. In FIG. 17, there is shown a simplified elevational view of a tug member 59B having the sloped surface 91B over which the steps 79B–89B are cammed upwardly and over the camming member 59B and a locking surface 93B that is indented to hold the steps during a retraction cycle of the hydraulic cylinder.

Figure 18:
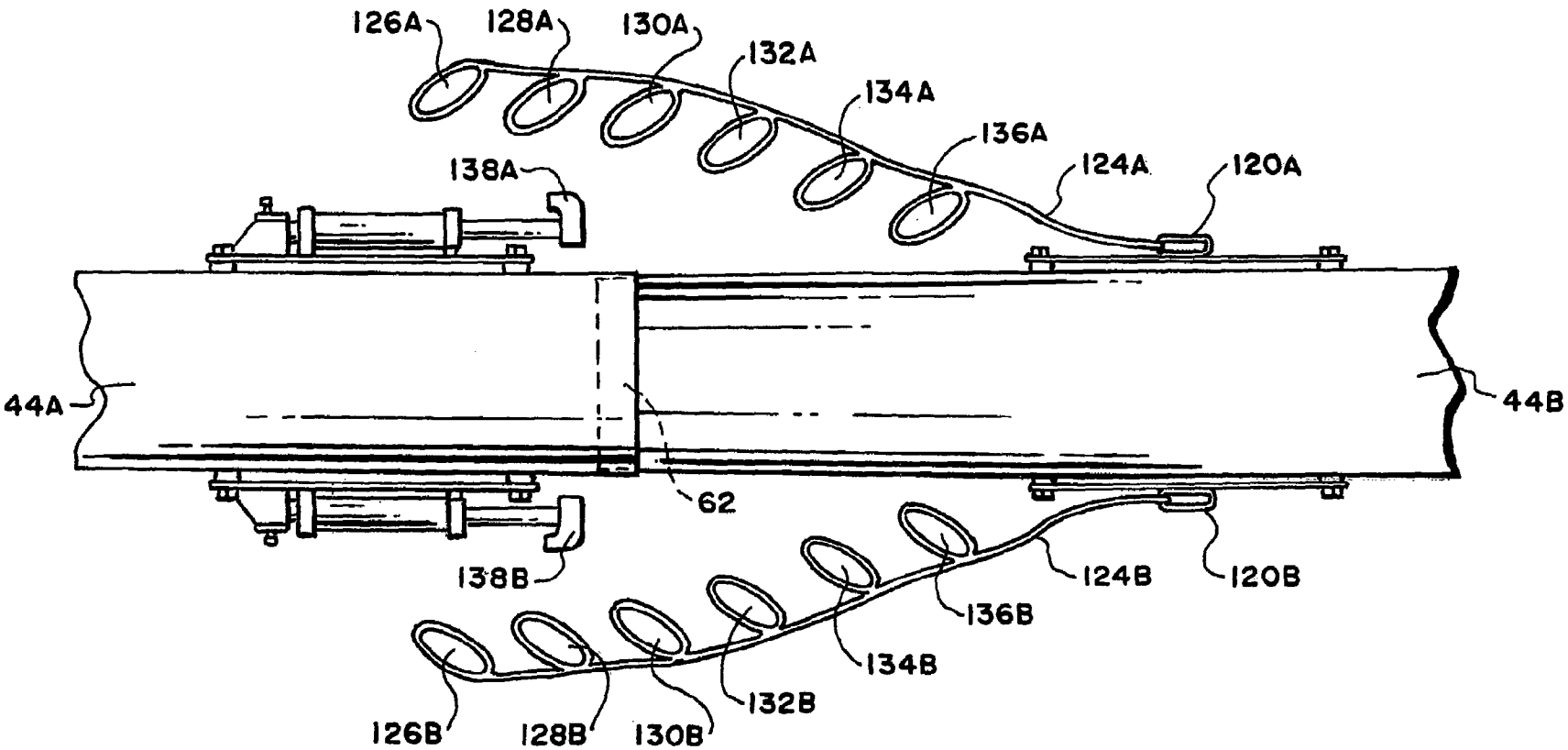
FIG. 18 is a plan view of still another embodiment of apparatus for pulling sections of a utility pole together.

In FIG. 18, there is shown an embodiment for performing the step 16A of pulling sections together with short repeated strokes by manually adjusting the position of a cord connecting the tug bracket and the tug arm of the embodiment of erecting utility poles 10A of FIG. 6. This embodiment includes some parts identical to those of the embodiments of FIGS. 10–17 and those parts include the same reference numbers as the embodiment of FIGS. 10–17. However, in the embodiment of FIG. 18, no camming action is performed. Instead, the tug brackets 120A and 120B have fastened to them individual cords 124A and 124B respectively. Each of the cords at its other end have six loops 126A–136A through 126B–132B and the pistons each have a corresponding connecting post 138A and 138B. In operation, the pistons 122A and 122B are extended and an appropriate one of the loops 126A–136A and 126B–136B is connected to maintain the cords 124A and 124B taunt. The pistons are then withdrawn to pull the sections 44A and 44B together. After a retraction stroke is completed, the pistons are extended and a different loop put on the posts 138A and 138B. In this manner the sections can be pulled quickly and effectively together.

Figures 19, 20, 21, 22:
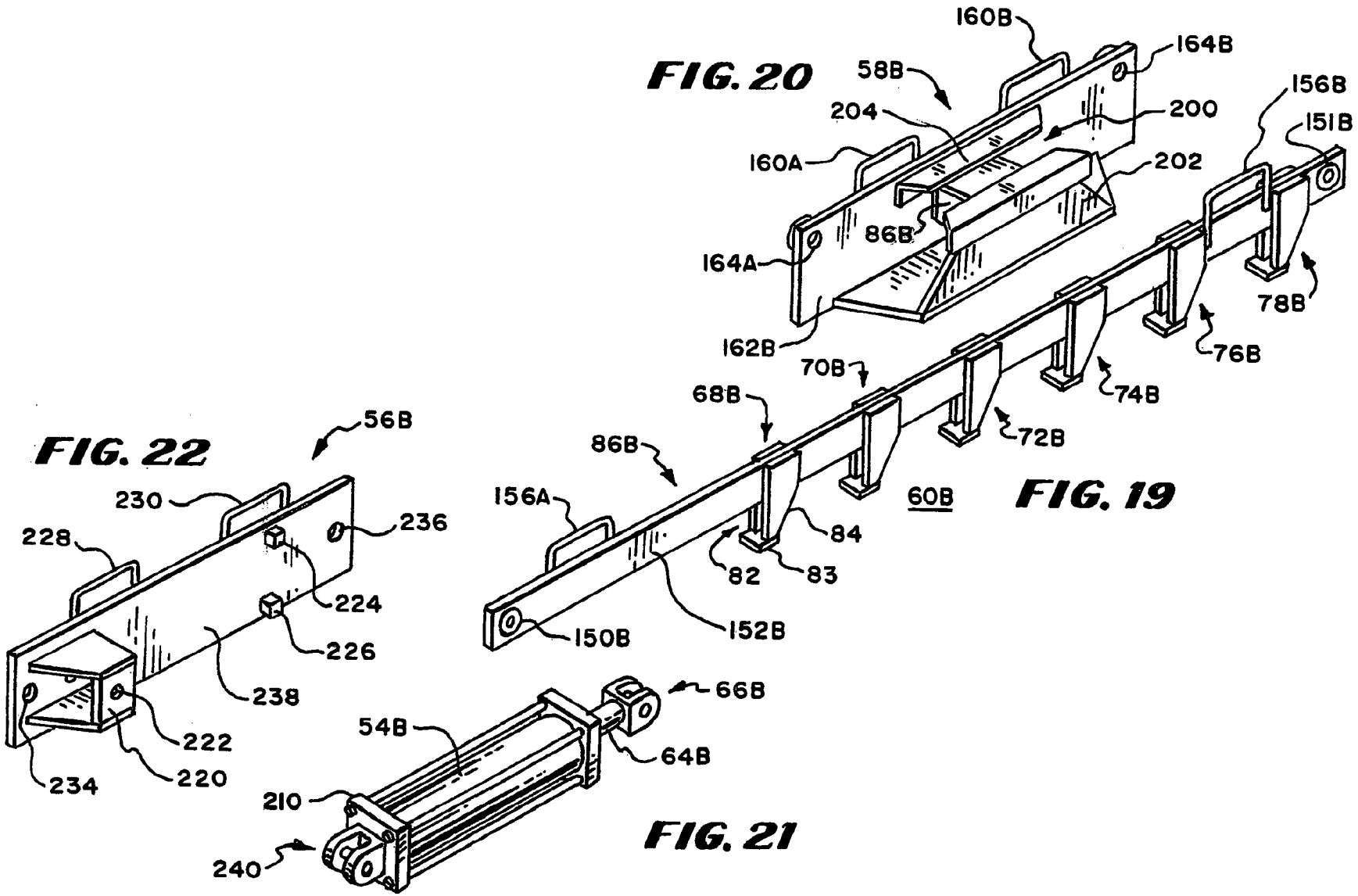
FIG. 19 is a perspective view of a tug arm used in the previous embodiments.
FIG. 20 is a perspective view of a tug bracket used in the previous embodiments.
FIG. 21 is a perspective view of a hydraulic cylinder used in the previous embodiments.
FIG. 22 is a perspective view of a hydraulic cylinder bracket used in the previous embodiments.

In FIG. 19, there is shown a perspective view of the tug arm 60B having an opening 150B at one end, and opening 151B at the other end, an elongated steel plate 152B, a plurality of teeth 68B–78B welded to the elongated plate 152B in spaced apart linear relationship. Each of the teeth corresponds to the tooth 68B which will be described in greater detail. The tooth 68B includes two steel plates, identically shaped welded on opposite sides of the plate 152B parallel to each other and having a straight top aligned with the top of the plate 152B, a downwardly extending straight edge 82 facing the opening 150, a slanted end 84 and approximately 50 degrees from the longitudinal axis of the elongated plate 152B and an ended member 154 extending beyond the surfaces 82 and connected both plates so as to form a gripping end for the tug bracket. Handles 156A and 156B extend from the tug arm for ease in carrying. The opening 150B is for pinning to the clevis at the end of a corresponding piston for an assembly of utility pole sections operation and the opening 151B is for pinning to the clevis at the end of a corresponding piston for a disassembly operation in which the sections are to be pushed apart.

In FIG. 20, there is shown a perspective view of a tug bracket having the square tug tube 56B, the base plate 162, openings 164A and 164B, and guide members 168B. The guide members 168B form a guide slot 200 comprised of a side member 202 and two angled members 204 and 206 which come together leaving the slot 200 over the tube 56B to guide the teeth of the tub arm. With this arrangement, the holes 164A and 164B are spaced thirty inches apart for attachment to a utility pole section. They are through the plate 162 which is forty inches in length by ten inches in depth and has mounted to the upper edge the handles 160A and 160B. The tube 56B is welded between the base plate 162B and the side member below the slot 200. The tug tube 5B6 is a generally one inch in outer diameter steel tube.

In FIG. 21, there is shown a perspective view of a hydraulic cylinder 54B having the piston rod 64B and end clevis 66B. It is mounted in the housing 210 and is a standard unit that is not in itself part of the invention except as it is used in combination with the other components of this system for erecting and disassembling utility poles and is used in the inventive processes of this invention. In FIG. 22 there is shown a perspective view of the bracket 56B having a base plate 238, an anchor 222, support members 224 and 226 and handles 228 and 230. At the end of the housing 210 is a mounting bracket 240 (FIG. 21) that fits withing the anchor 220 and receives a bolt that also passes through the opening 222 in the anchor 220. The anchor, bolt and support members 224 and 226 hold the hydraulic cylinder to the bracket of FIG. 22. The support plate includes two openings 234 and 236 to which match openings in the utility pole sections for mounting the bracket to the utility pole.

Figure 23:
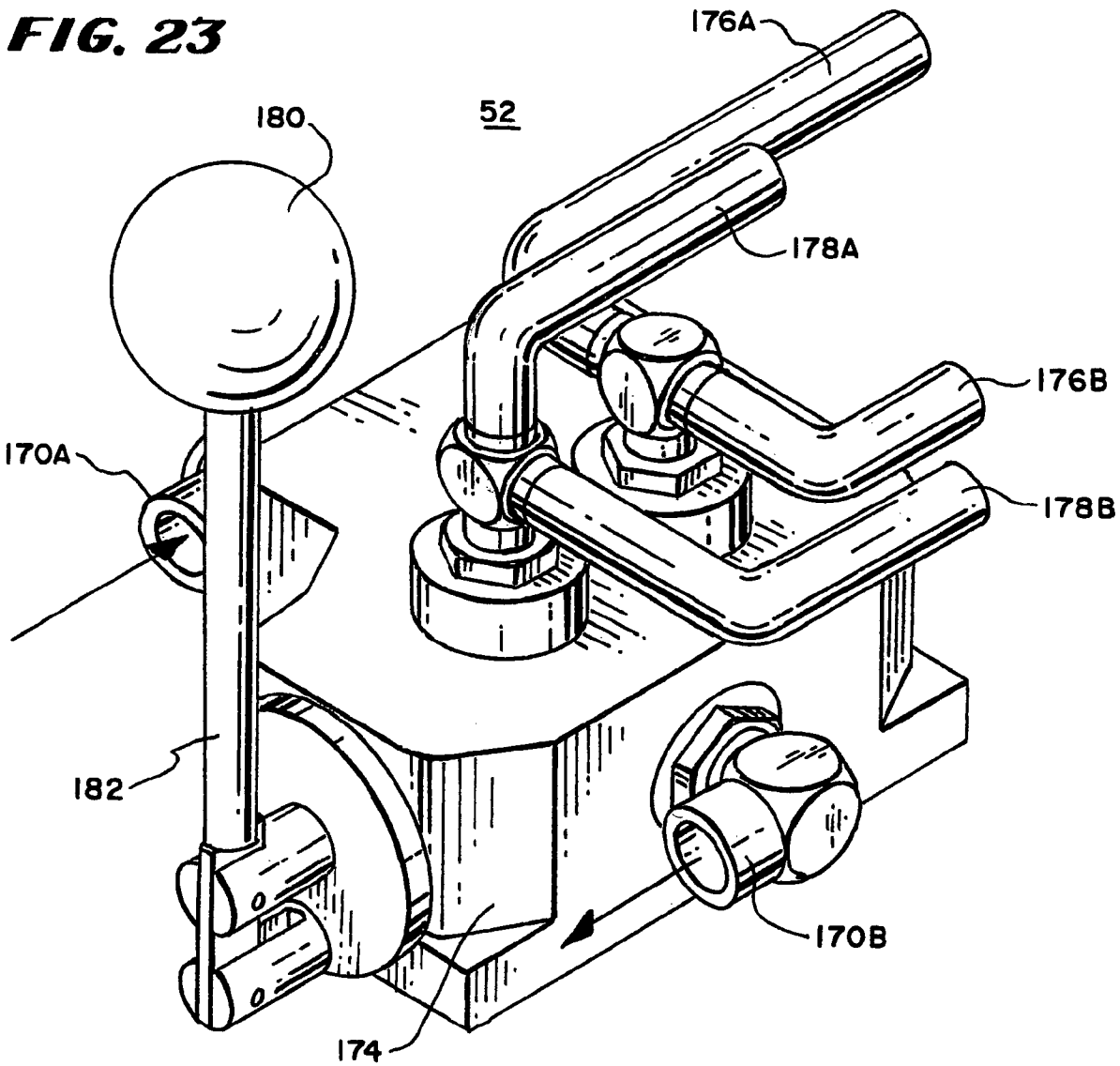
FIG. 23 is a perspective view of a hydraulic valve system used in the previous embodiments.

In FIG. 23, there is shown a perspective drawing of the hydraulic valve system 52 having hydraulic lines 170A and 170B communicating with a source of hydraulic fluid with line 170A being an inlet line to the valve system and 170B being a return line. The conduits 170A and 170B communicate with the interior of the hydraulic tank 174 which has four conduits 178A and 178B being outlet conduits connected to the hydraulic cylinders 54A and 54B and return lines 176A and 176B communicating with corresponding ones of the hydraulic cylinders 54A and 54B (FIG. 9). A valve control handle 182 is utilized to switch the fluid flow from the extension fluid to the return fluid in a manner known in the art.

From the above description, it can be understood that the system for erecting utility poles of this invention has several advantages, such as: (1) it is relatively inexpensive; (2) it takes less time to erect a metal utility pole than prior art systems that lacked automatic mechanisms for pulling the utility pole sections together; and (3) it is safe and the equipment is relatively easy to handle.

Although a preferred embodiment of the invention has been described with some particularity, many modifications and variations are possible within the light of the above teachings. Therefore, it is to be understood that, within the scope of the appended claims, the invention may be practiced other than as specifically described.

I claim:

1. An apparatus for assembling utility poles having at least two interconnecting sections comprising:

first and second powered pulling devices;

first and second tug arms, said first and second tug arms each including a main arm having a rearward end and a forward end and at least two bracket-engagement elements mounted thereon;

first and second tug brackets each adapted for mounting on opposite sides of a first utility pole section, said first and second tug brackets each including an element engagement section releasably engagable by an adjacent one of said at least two bracket-engagement elements of said first and second tug arms;

tug bracket mounting means for releasably mounting said first and second tug brackets on opposite sides of the first utility pole;

powered pulling device mounting means for releasably mounting said first and second powered pulling devices on opposite sides of a second utility pole section;

said first and second tug arms connectable to a respective one of said first and second powered pulling devices and said element engagement sections of said first and second tug brackets such that said first and second tug arms extend between and releasably connect said first and second tug brackets and first and second powered pulling devices;

said first and second powered pulling devices operative to pull said first and second tug arms towards said first and second powered pulling devices thus pulling the first and second utility pole sections towards one another until they are tightly secured to one another; and said first and second powered pulling devices further operative to push said first and second tug arms away from said first and second powered pulling devices so that said adjacent one of said at least two bracket-engagement elements disengages from said first and second tug brackets and a second one of said at least two bracket-engagement elements engages said first and second tug brackets whereby alternately pulling and pushing said first and second tug arms via said first and second powered pulling devices draws the first and second utility pole sections towards one another until they are tightly secured to one another.

2. The apparatus of claim 1 wherein said first and second powered pulling devices each comprises an hydraulic cylinder including a retractable and extendable piston having a forward end.

3. The apparatus of claim 1 wherein said at least two bracket-engagement elements further comprise at least two tug arm teeth mounted on and extending outwards from said main arm, said at least two tug arm teeth each including a rearward bracket-engagement side and a forward side having a forwardly-angled face.

4. The apparatus of claim 3 wherein said forwardly-angled face of said forward side of each of said at least two tug arm teeth is operative to slide over said first and second tug brackets upon said first and second powered pulling devices pushing said first and second tug arms away from said first and second powered pulling devices, said each of said at least two tug arm teeth operative to then drop downwards to permit said rearward bracket-engagement side of said each of said at least two tug arm teeth to engage said first and second tug brackets.

5. A method of assembling utility poles having at least two interconnecting sections comprising the steps:

providing first and second powered pulling devices;

providing first and second tug arms each including a main arm and at least two bracket-engagement elements, said at least two bracket-engagement elements further including at least two tug arm teeth mounted on and extending outwards from said main arm, said at least two tug arm teeth each including a rearward bracket-engagement side and a forward side having a forwardly-angled face;

providing first and second tug brackets each adapted for mounting on opposite sides of a first utility pole section, said first and second tug brackets each including a projection engagement section each releasably engagable by an adjacent one of said at least two bracket-engagement elements of said first and second tug arms;

mounting said first and second powered pulling devices on opposite sides of a second utility pole section to be connected with the first utility pole section;

mounting said first and second tug brackets on opposite sides of the first utility pole section;

connecting one of said first and second tug arms to a respective one of said first and second powered pulling devices;

engaging said projection engagement sections of said first and second tug brackets via said adjacent ones of said at least two bracket-engagement elements of said first and second tug arms such that said first and second tug arms extend between and releasably connect said first and second tug brackets and said first and second powered pulling devices; and retractably engaging said first and second powered pulling devices to pull said first and second tug arms towards said first and second powered pulling devices thus pulling the first and second utility pole sections towards one another until the first and second utility pole sections are tightly secured to one another.

6. The method of claim 5 wherein said step of providing first and second powered pulling devices further comprises providing first and second hydraulic cylinders each including a retractable and extendable piston having a forward end.

7. The method of claim 5 wherein in said step of extendably engaging said first and second powered pulling devices to push said first and second tug arms away from said first and second powered pulling devices, said forwardly-angled face of said forward side of a second of said at least two tug arm teeth slides over said first and second tug brackets and then drops downwards to permit said rearward bracket-engagement side of said second of said at least two tug arm teeth to engage said first and second tug brackets.

8. A method of assembling utility poles having at least two interconnecting sections comprising the steps:

providing first and second hydraulic cylinders including retractable and extendable pistons each having forward ends;

providing first and second tug arms, said first and second tug arms each including a main arm having a rearward end and a forward end and at least two tug arm teeth mounted on and extending outwards from said main arm, said at least two tug arm teeth each including a rearward bracket-engagement side and a forward side having a forwardly-angled face;

providing first and second tug brackets each adapted for mounting on opposite sides of a first utility pole section, said first and second tug brackets each including a tug arm teeth engagement section releasably engagable by an adjacent rearward bracket-engagement side of one of said at least two tug arm teeth;

mounting said first and second hydraulic cylinders on opposite sides of a second utility pole section to be connected with the first utility pole section;

mounting said first and second tug brackets on opposite sides of the first utility pole section;

pivotably connecting one of said rearward ends of said first and second tug arms to a respective one of said forward ends of said pistons of said first and second hydraulic cylinders;

engaging said tug arm teeth engagement sections of said first and second tug brackets via one of said at least two tug arm teeth of said first and second tug arms such that said first and second tug arms extend between and releasably connect said first and second tug brackets and said pistons of said first and second hydraulic cylinders;

retractably engaging said first and second hydraulic cylinders to retract said pistons and pull said first and second tug arms towards said first and second hydraulic cylinders thus pulling the first and second utility pole sections towards one another;

extendably engaging said first and second hydraulic cylinders to extend said pistons and push said first and second tug arms away from said first and second hydraulic cylinders so that said forwardly-angled face of said forward side of a second of said at least two tug arm teeth slides over said first and second tug brackets and then drops downwards to permit said rearward bracket-engagement side of said second of said at least two tug arm teeth to engage said first and second tug brackets; and repeating said retractably engaging and said extendably engaging steps until the first and second utility pole sections are tightly secured to one another.

9. A method of assembling utility poles having at least two interconnecting sections comprising the steps:

providing first and second powered pulling devices;

providing first and second tug arms each including a main arm and at least two bracket-engagement elements;

providing first and second tug brackets each adapted for mounting on opposite sides of a first utility pole section, said first and second tug brackets each including a projection engagement section each releasably engagable by an adjacent one of said at least two bracket-engagement elements of said first and second tug arms;

mounting said first and second powered pulling devices on opposite sides of a second utility pole section to be connected with the first utility pole section;

mounting said first and second tug brackets on opposite sides of the first utility pole section;

connecting one of said first and second tug arms to a respective one of said first and second powered pulling devices;

engaging said projection engagement sections of said first and second tug brackets via said adjacent ones of said at least two bracket-engagement elements of said first and second tug arms such that said first and second tug arms extend between and releasably connect said first and second tug brackets and said first and second powered pulling devices; and retractably engaging said first and second powered pulling devices to pull said first and second tug arms towards said first and second powered pulling devices thus pulling the first and second utility pole sections towards one another;

extendably engaging said first and second powered pulling devices to push said first and second tug arms away from said first and second powered pulling devices so that said adjacent one of said at least two bracket-engagement elements disengages from said first and second tug brackets and a second one of said at least two bracket-engagement elements engages said first and second tug brackets; and repeating said retractably engaging and said extendably engaging steps until the first and second utility pole sections are tightly secured to one another.

* * * * *